United States Patent [19]

Andres et al.

[11] 4,448,241

[45] May 15, 1984

[54] HEAT-EXCHANGER WITH A BUNDLE OF PARALLELLY EXTENDING PIPES ADAPTED TO BE ACTED UPON BY AIR

[75] Inventors: Rudolf Andres; Helmut Grantz, both of Sindelfingen; Wolf-Dietrich Münzel, Ehningen; Wolfgang Odebrecht, Sindelfingen, all of Fed. Rep. of Germany

[73] Assignee: Daimler-Benz Aktiengesellschaft, Fed. Rep. of Germany

[21] Appl. No.: 437,571

[22] Filed: Oct. 29, 1982

[30] Foreign Application Priority Data

Oct. 31, 1981 [DE] Fed. Rep. of Germany ..... 3143332

[51] Int. Cl.[3] ..... F28D 15/00

[52] U.S. Cl. ..... 165/104.14; 165/104.21; 165/140; 165/48 R; 165/42; 29/157.3 R; 29/157.3 V

[58] Field of Search ..... 165/140, 104.21, 104.26, 165/104.14, 48, 42; 29/157.3 R, 157.3 V

[56] References Cited

U.S. PATENT DOCUMENTS 3,603,379 9/1971 Leonard, Jr. ..... 165/104.21

3,809,154 5/1974 Heller et al. ..... 165/104.21

4,333,520 6/1982 Yanadori et al. ..... 165/104.21

*Primary Examiner*—Albert W. Davis, Jr.

*Attorney, Agent, or Firm*—Craig & Burns

[57] ABSTRACT

A heat-exchanger with a bundle of parallelly extending metallic pipes arranged at least in one row which are hermetically closed off and constructed in the manner of heat pipes, and with at least one metallic heat-exchanger head extending transversely to the pipe bundle which is sealed off from a flow point of view with respect to the pipe hollow spaces of the pipe bundle but is in heat-transferring connection therewith; the heat-exchanger head is thereby formed of at least one three-layered flat partial composite laminated body per pipe row which includes two separate channels or channel networks, and which is directed parallel to the associated pipe row; one of the channels of a partial composite laminated body is thereby connected with the heat pipe hollow spaces of the pipe row to form a heat pipe channel while the other channel is adapted to be acted upon by the heat carrier medium and forms a heat carrier channel.

33 Claims, 6 Drawing Figures

HEAT-EXCHANGER WITH A BUNDLE OF PARALLELLY EXTENDING PIPES ADAPTED TO BE ACTED UPON BY AIR

The present invention relates to a heat-exchanger with a bundle of parallelly extending pipes adapted to be acted upon by air as disclosed, for example, in the non-prepublished German Offenlegungsschrift No. 30 31 624.

The heat-exchanger disclosed therein serves selectively for the cooling or heating of the passenger space of a motor vehicle. Different heat-exchanger heads are provided at the two ends of the pipe bundle, of which one can be acted upon with hot water for the heating and the other with a cooling medium for the cooling. The distibution of the supplied heat, respectively, of the cooling output onto the air stream takes place by means of the pipe bundle, whose pipes are constructed as so-called heat pipes, known as such. Similar arrangements of a heat-exchanger selectively usable both for cooling and heating are disclosed in the German Offenlegungsschriften Nos. 27 56 119 and 28 00 265.

It is the aim of the present invention to indicate a constructional form of the heat-exchanger which can be manufactured in a rational manner and which permits an expectation of a good heat transfer between the heat carrier medium and the heat pipes.

The underlying problems are solved in accordance with the present invention in that the heat-exchanger head is formed of at least one three layered partial composite laminated body expanded by compressed air and enclosing two separate channels or channel networks per pipe row, which heat-exchanger head is aligned parallel to the associated pipe row, whereby one of the channels of a partial composite laminated body—the heat pipe channel—is connected with the heat pipe hollow spaces of the pipe row and the other channel—heat carrier channel—is adapted to be acted upon by the heat carrier medium. Owing to the use of three layered partial composite laminated bodies with two separate channels, respectively channel networks, many mutually separated channels can be formed in a rational and price-favorable manner, between which an intimate heat-conducting connection exists nonetheless. On the other hand, by reason of a tight packing of many mutually adjoining partial composite laminated bodies in a small space, an intimate heat-exchange becomes possible between the different flow spaces.

These and other objects, features and advantages of the present invention will become more apparent from the following description when taken in connection with the accompanying drawing which shows, for purposes of illustration only, several embodiments in accordance with the present invention, and wherein.

Figure 1:
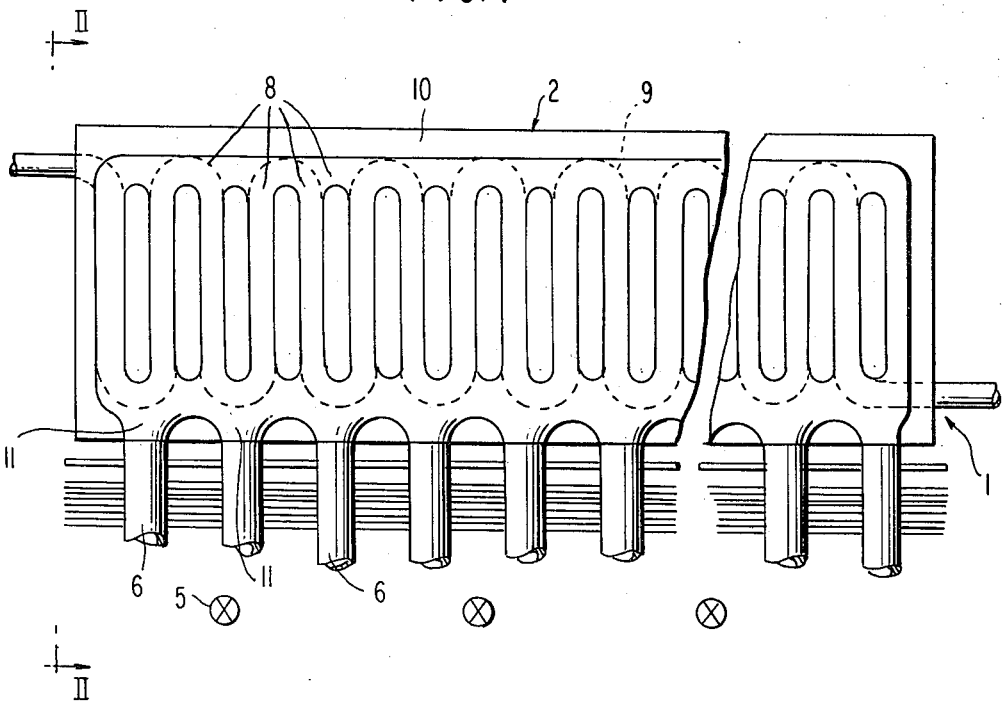
FIG. 1 is an elevational view in the direction of air flow of a first embodiment of a heat-exchanger according to the present invention with round pipes within a pipe bundle.
Figure 2:
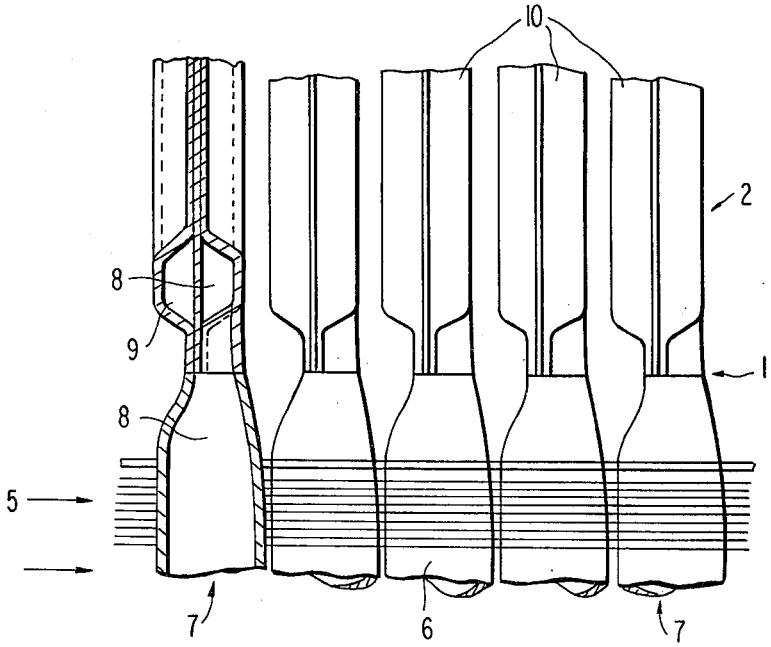
FIG. 2 is an elevational view, at right angle to FIG. 1, of the heat-exchanger illustrated therein, with one partial composite laminated body in cross section taken along line II—II of FIG. 1.
Figure 3:
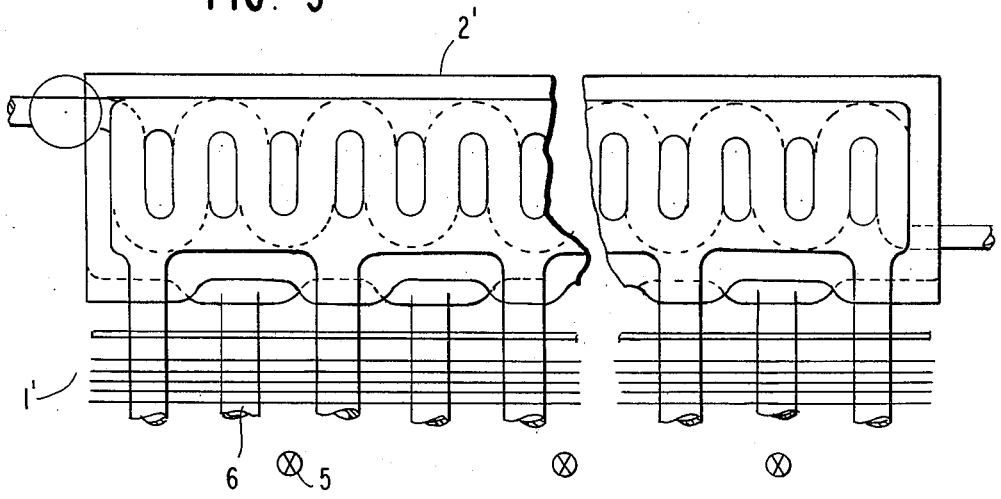
FIG. 3 is an elevational view similar to FIG. 1 of a further embodiment of a heat-exchanger according to the present invention with two partial composite laminated bodies per pipe row.
Figure 4:
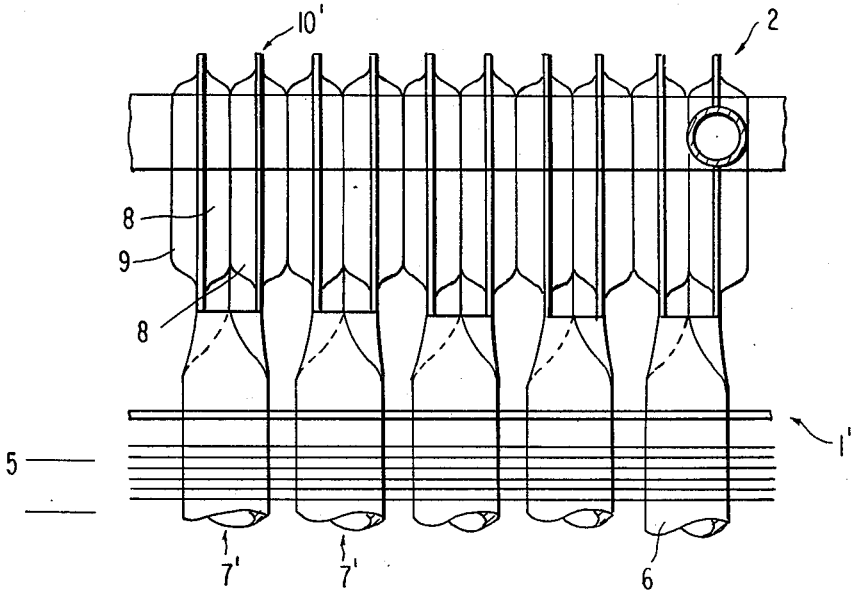
FIG. 4 is an elevational view, at right angle to FIG. 3, of the heat-exchanger illustrated in FIG. 3.

Referring now to the drawing wherein like reference numerals are used throughout the various views to designate like parts, the two heat-exchangers generally designated by reference numeral 1, respectively, 1' illustrated in FIGS. 1 to 4 essentially consist of a heat-exchanger head generally designated by reference numeral 2, respectively, 2', as well as of a pipe bundle of parallelly extending pipes 6 adapted to be acted upon by air and starting from the heat-exchanger head 2, respectively, 2'; the pipe bundle of parallelly extending pipes 6, in its turn, consists of several parallel pipe rows generally designated by reference numeral 7, respectively 7', of approximately equal length and disposed adjacent one another which are arranged transversely to the air stream 5. The pipes 6 of the pipe bundle are in communication with each other groupwise and form heat-exchanger hollow spaces which are separated from a flow point of view and sealed off with respect to the spaces of the heat-exchanger head adapted to be acted upon by the heat carrier medium. A good heat-transferring connection exists inside of the heat-exchanger head 2, respectively, 2' between the flow channels of the heat carrier medium, i.e., the heat carrier channels 9, on the one hand, and the parts of the heat-pipe hollow spaces of the pipe bundle disposed in the heat-exchanger head, i.e., the heat-pipe channels 8, on the other. The heat-pipes distribute the absorbed heat over the entire cross section of the air stream 5 at low temperature gradients.

Two heat-exchanger heads may also be provided at the pipe bundle, of which one is arranged appropriately at the top and is adapted to be acted upon with a cooling medium to be evaporated during the cooling of the air stream whereas the lower connection box is used during heating and is then traversed by hot water. The heat-pipe hollow spaces of the pipe bundle, respectively, of the pipe rows extend both into the upper as also into the lower heat-exchanger head. During heating, the medium disposed in the heat pipe hollow spaces is evaporated at the bottom, rises in the pipes 6, gives off the heat to the air stream by way of the pipe walls and condenses along the pipe inside; the condensate flows back to the heated place by gravitational influence and/or by capillary action of a corresponding structuring of the pipe inside so that the circulation closes. During the cooling of the air stream, the heating water supply is, of course, turned off and in lieu thereof cooling medium to be evaporated is conducted through the upper connection box. During this type of operation, the medium present in the heat pipe hollow spaces is evaporated in the pipes 6 of the bundle exposed to the air stream, whereby heat is removed from the air. The evaporated medium rises on the pipe inside and condenses in the sections of the heat pipe hollow spaces disposed in the upper connection box, whereby the absorbed heat is transferred to the cooling medium and the latter evaporates. The formed condensate flows down by gravitational influence and/or by capillary action on the pipe inside into the part of the heat-pipe hollow spaces which are exposed to the air stream 5 whereby again the circulation closes. In every case, the condensation part of the heat-pipe hollow space is arranged above the evaporation part in the gravitational direction so that a condensate return flow is favored by gravitational influence. This becomes effective in a favorable manner on a high capacity heat transfer. For purposes of improving the heat transfer between the inflowing air and the pipes 6, apertured sheet metal plates are shrunk onto the pipes 6, between which the air sweeps through. The shrink-fit is appropriately produced by an expansion of the pipes after the threading of the sheet metal elements.

In the heat-exchangers according to FIGS. 1 to 4, the heat-exchanger heads are formed by several three-layered partial composite laminated bodies expanded by compressed air which are arranged thereat transversely to the direction of the air stream 5. In the embodiment according to FIGS. 1 and 2, one partial composite laminated body 10 is provided for each pipe row, whereas in the embodiment according to FIGS. 3 and 4, two partial composite laminated bodies 10' are present for each pipe row. By reason of the three-layered construction of the flat partial composite laminated body, two separate channels or channel networks can be formed within the same, whereby one forms the heat-pipe channel 8 and the other the heat carrier channel 9 of the heat-exchanger head. The heat-pipe channel 8 is constructed in the form of an approximately ladder-shaped channel network whose channel sections corresponding to the ladder rungs are disposed parallel to the pipe 6. In contrast thereto, the heat carrier channel 9 is constructed without branching and extends meander-shaped over the entire area of the partial composite laminated body, whereby the vertical channel sections of the heat carrier channel 9 are congruent with the channel sections of the heat-pipe channel corresponding to the ladder rungs so that both types of channels are arranged congruent over as large as possible a part of their course. The heat-pipe channel 8 of a partial composite laminated body includes several cross-intersecting channels 11 extending toward the edge, of which one each is sealingly connected, for example, by brazing, with a pipe of the corresponding pipe row. The pipe is somewhat flattened off at the corresponding transition place whereas the intersecting channel is somewhat enlarged compared to the other channel cross sections.

In the embodiments according to FIGS. 1 to 4, the heat pipe hollow spaces of the different partial composite laminated bodies have no cross connection among each other. With the partial composite laminated bodies disposed transversely to the air flow direction, the heat-pipe hollow spaces can be adjusted thereby each for itself by reason of an individual filling individually to predetermined operating points so that also an optimum heat transfer can still be achieved also with pipe rows disposed further to the rear in the air stream notwithstanding the decreasing temperature gradient between the air and the pipes.

By the double arrangements of partial composite laminated bodies 10' per pipe row 7', greater heat-exchange surfaces can be accommodated per structural volume unit of the heat-exchanger head between the heat carrier channels and the heat-pipe channels so that with a predetermined length and width of the heat-exchanger head, the latter can be constructed more flat. The double arrangement of partial composite laminated bodies per pipe row additionally entails the advantage that the latter are stacked in block inside of the heat-exchanger head which, however, presupposes that the overall thickness of a partial composite laminated body corresponds to at least approximately half the pipe diameter and for which purpose the pipes of adjacent partial composite laminated bodies must be additionally arranged mutually offset in the length direction to each other so that the composite laminated bodies of one pipe row are located in the gap areas of each adjacent row. In order to be able to arrange the pipes coordinated to a pair of partial composite laminated bodies in a straight pipe row 7', the pipes coordinated to a partial composite laminated body are extended eccentrically toward the same and the two partial composite laminated bodies coordinated to a pipe row are then arranged mirror-image-like to one another with the associated pipes.

Figure 5:
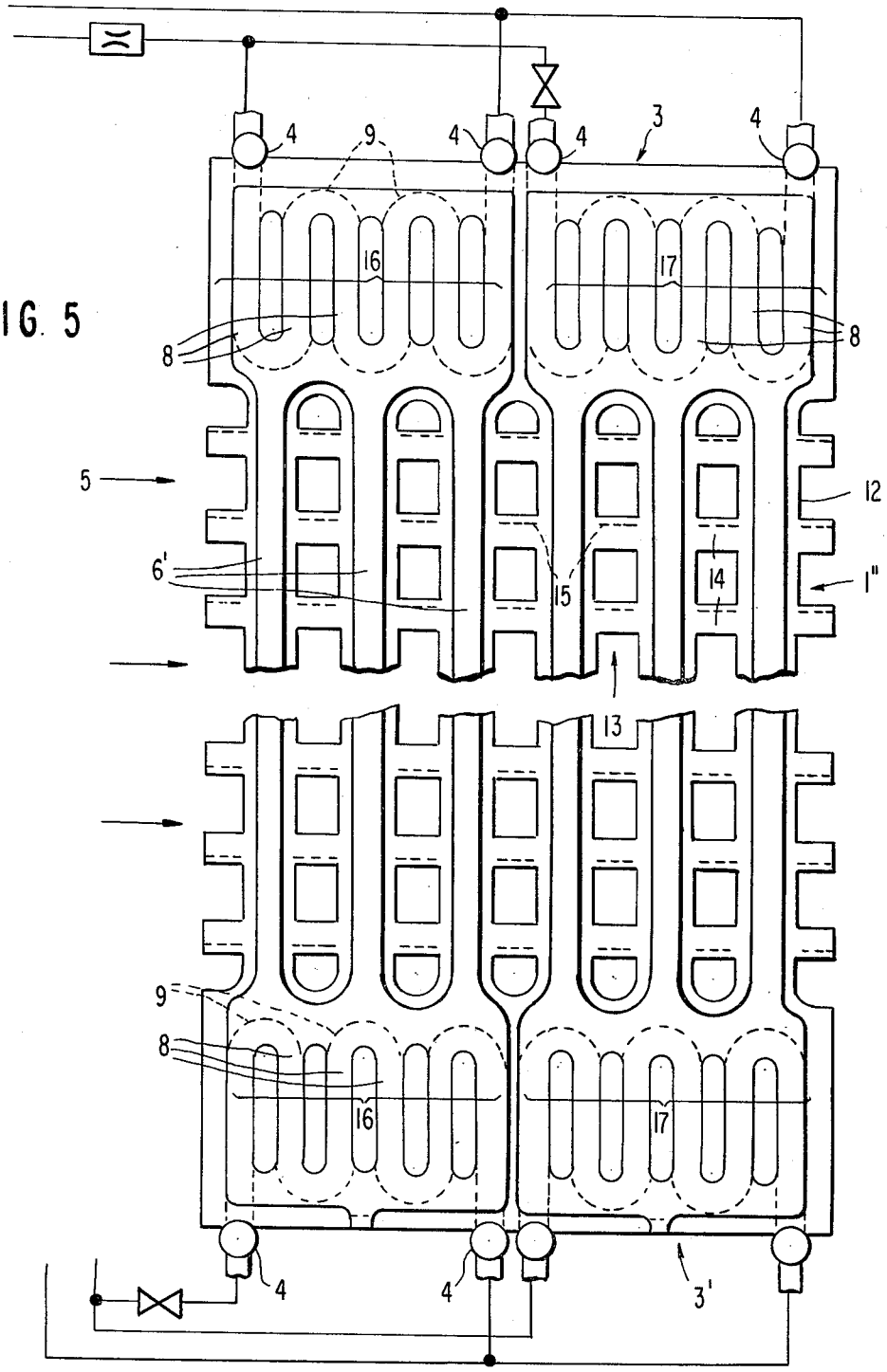
FIG. 5 is a side elevational view, transversely to the air stream, of a further embodiment of a heat-exchanger according to the present invention in which also the pipes adapted to be acted upon by air are formed by the partial composite laminated bodies.
Figure 6:
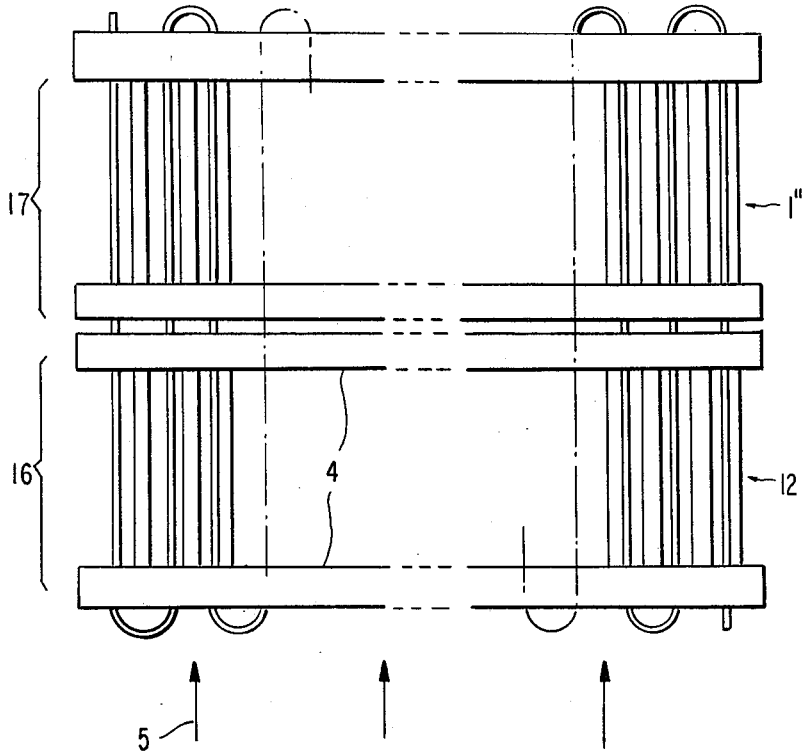
FIG. 6 is a top plan view on the heat-exchanger of FIG. 5.

In the embodiment of a heat-exchanger illustrated in FIGS. 5 and 6, also the pipes 6' of a pipe row of the pipe bundle are formed in the form of an expanded partial composite laminated body which together with the partial composite laminated body of the heat-exchanger head 3, respectively 3', belonging to the row is integrated into a one-piece structural unit of a heat exchanger plate 12. With this construction of the pipe rows, the pipes have a fish-shaped cross section so that it is appropriate to direct the air stream parallel to the pipe rows. In order to enable an air passage transversely to the heat-exchanger plates, longitudinal slots 13 extending parallel to the pipes 6' are arranged therebetween which are subdivided into several shorter apertures arranged one behind the other by stabilizing webs 14. In order to favor the heat-exchange between the air and the part of the heat-exchanger plate acted upon by the air, several tongues 15 projecting out of the plane of the plate are provided within the area between the individual pipes in the manner of heat-transfer ribs which are punched out of the plate material and are bent over.

As shown in the top plan view according to FIG. 6, the several partial composite laminated bodies of the heat-exchanger may be formed of a continuous plate by zig-zag-shaped folds. This opens up the possibility to utilize larger plates of partial composite laminated bodies which can be manufactured and handled in a more rational manner.

The embodiment of the heat-exchanger 1' illustrated in FIGS. 5 and 6 has two identical heat-exchanger heads 3 and 3'. The peculiarity of this heat-exchanger resides, inter alia, in the subdivision of the heat-exchanger heads; more particularly, they are subdivided transversely to the direction to the pipe rows, respectively, transversely to the direction of the air flow into two mutually separated sections each provided separately with inlet and outlet connections leading toward the outside. The heat-pipe channels 9 of the individual partial composite laminated bodies disposed adjacent one another are connected with each other from a flow point of view on the inlet side and outlet side by way of a connecting pipe 4 each, in which terminates an inlet connection respectively from which starts an outlet connection. Owing to the subdivision of the heat-exchanger heads into two sections disposed one behind the other, the sections can be turned off individually so that only one of the sections and, accordingly, the associated part of the heat-exchanger head, can be acted upon by itself in an isolated manner. Such a construction of the heat-exchanger, respectively, of the heat-exchanger head is purposeful for the drying of humid air. In that case, the first three pipes 6' of the pipe rows located in the air stream ar cooled in that cooling medium tempered with a temperature below the dew point temperature of the air is supplied to the upper connection box 3, whereby the rear section of the heat-exchanger head is turned off and the three rear pipes of the pipe rows are correspondingly not cooled. Simultaneously therewith, however, the lower heat-exchanger head 3' is acted upon with heating water whereby in that case the front section thereof is turned off and only the rear pipes of the pipe rows are heated. By such an operation, the humidity can be removed from the air fed through the heat-exchanger in that the humidity is condensed at the cold front pipes, subsequently, the cooled air is again heated at the rear pipes to normal temperature so that the dried air receives or retains normal space temperature. Partial composite laminated bodies or structures, as the term is used herein are such structures, also known as so-called "Roll-Bond" plates or structures, which consist of a corresponding number of aluminum plates that, for example, are imprinted with a separating substance at those places where the plates are intended to form hollow spaces and are subsequently rolled together one lying upon the other, as a result of which the plates are intimately welded together by the rolling pressure and the material deformation at the non-imprinted places. By blowing compressed air into the non-welded places, the gaps located thereat are inflated or expanded into channels whereby a corresponding shaping tool assures a defined pneumatic channel enlargement.

While we have shown and described several embodiments in accordance with the present invention, it is understood that the same is not limited thereto but is susceptible of numerous changes and modifications as known to those skilled in the art, and we therefore do not wish to be limited to the details shown and described herein, but intend to cover all such changes and modifications as are encompassed by the scope of the appended claims.

We claim:

1. A heat-exchanger with a bundle of metallic pipe means extending substantially parallelly to one another and adapted to be acted upon by air, said pipe means being hermetically closed and constructed in the manner of heat-pipe means, and at least one metallic heat-exchanger head means extending transversely to the pipe bundle and adapted to be traversed by a heat carrier medium, said heat-exchanger head means being sealed off from a flow point of view with respect to the heat-pipe hollow spaces of the pipe bundle but being in heat-transferring connection therewith, characterized in that the heat-exchanger head means is formed of at least one expanded three-layered flat partial composite laminated body means per pipe row which includes two separate channel means, said body means being aligned substantially parallelly to the associated pipe row, one of the channel means of a body means being operatively connected with the heat-pipe hollow spaces of the pipe row to form a heat-pipe channel means while the other channel is adapted to be acted upon by a heat carrier medium and forms a heat carrier channel means.

2. A heat-exchanger according to claim 1, characterized in that the pipe means are arranged in several rows of at least approximately equal length and disposed parallel to one another.

3. A heat-exchanger according to claim 1 or 2, characterized in that the partial composite laminated body means includes two separate channel networks.

4. A heat-exchanger according to claim 1, characterized in that the heat-pipe channel means is constructed in the form of an approximately ladder-shaped channel network whose channel sections corresponding to the rungs of the ladder are disposed substantially parallel to the pipe means of the pipe row.

5. A heat-exchanger according to claim 4, characterized in that the heat-pipe channel means includes several cross-intersecting channels extending to the edge of the body means, of which one each is sealingly connected with a pipe means of the corresponding pipe row.

6. A heat-exchanger according to claim 5, characterized in that the heat-carrier channel means extends non-branched and meander-shaped over the entire area of the body means.

7. A heat-exchanger according to claim 6, characterized in that the heat carrier channel means and the heat pipe channel means are arranged substantially congruent over at least a large portion of their course.

8. A heat-exchanger according to claim 7, characterized in that two partial composite laminated body means are provided per pipe row and heat-exchanger head means, whereby alternately one pipe means is extended to the one body means and the next pipe means to the other body means.

9. A heat-exchanger according to claim 8, characterized in that the pipe means are extended to the body means eccentrically and alternately mirror-image-like.

10. A heat-exchanger according to claim 8, characterized in that the overall thickness of a body means corresponds at least approximately to half the pipe diameter and in that the body means of a heat-exchanger head means are stacked in a block while the pipe means which are coordinated to adjacent body means are arranged substantially pipe-on-gap relative to one another.

11. A heat-exchanger according to claim 10, characterized in that the pipe rows and body means are arranged transversely to the air stream.

12. A heat-exchanger according to claim 10, characterized in that the pipe means of a row are also constructed in the form of expanded partial composite laminated body means which together with the partial composite laminated body means of the heat-exchanger head means belonging to the same row are integrated into a one-piece structural unit of a heat-exchanger plate means.

13. A heat-exchanger according to claim 12, characterized in that the heat-exchanger plate means are provided with longitudinal slots extending between the pipe means substantially parallelly thereto for an air passage directed transversely to the heat-exchanger plate means.

14. A heat-exchanger according to claim 13, characterized in that the longitudinal slots are subdivided into several shorter apertures arranged one behind the other by stabilizing web means.

15. A heat-exchanger according to claim 14, characterized in that the heat-exchanger plate means include within the area of the individual pipe means several tongue portions projecting out of the plane of the plate means and punched out of the plate material in the manner of heat-transfer ribs.

16. A heat-exchanger according to claim 15, characterized in that the heat-exchanger plate means are aligned substantially parallel to the air stream.

17. A heat-exchanger according to claim 16, characterized in that the body means of the heat-exchanger and of the heat-exchanger head means are formed by a correspondingly larger partial composite laminated body uniformly folded flat one over the other in zig-zag shape.

18. A heat-exchanger according to claim 15 or 17, characterized in that one heat-exchanger head means each is provided at the two ends of the pipe bundle, of which one is adapted to be acted upon by a heat-carrier medium warmer that the space temperature and the other with a heat-carrier medium colder than the dew point temperature of the acted-upon air, and in that the heat-carrier channel means of the body means are subdivided within the area of the two heat-exchanger head means into two independent sections disposed one behind the other in the air flow direction and each provided with separate inlet and outlet connections, in such a manner that only a part of the pipe rows of the pipe bundle is adapted to be acted upon by itself by one of the heat-exchanger head means and at the same time the other part of the pipe row is adapted to be acted upon by the other heat-exchanger head means.

19. A heat-exchanger according to claim 18, characterized in that the sections are of substantially equal size.

20. A heat-exchanger according to claim 1, characterized in that the heat-pipe channel means includes several cross-intersecting channels extending to the edge of the body means, of which one each is sealingly connected with a pipe means of the corresponding pipe row.

21. A heat-exchanger according to claim 1, characterized in that the heat-carrier channel means extends nonbranched and meander-shaped over the entire area of the body means.

22. A heat-exchanger according to claim 1, 20 or 21, characterized in that the heat-carrier channel means and the heat-pipe channel means are arranged substantially congruent over at least a large portion of their course.

23. A heat-exchanger according to claim 1, characterized in that two partial composite laminated body means are provided per pipe row and heat-exchanger head means, whereby alternately one pipe means is extended to the one body means and the next pipe means to the other body means.

24. A heat-exchanger according to claim 23, characterized in that the pipe means are extended to the body means eccentrically and alternately mirror-image-like.

25. A heat-exchanger according to claim 23, characterized in that the overall thickness of a body means corresponds at least approximately to half the pipe diameter and in that the body means of a heat-exchanger head means are stacked in a block while the pipe means which are coordinated to adjacent body means are arranged substantially pipe-on-gap relative to one another.

26. A heat-exchanger according to claim 1, characterized in that the pipe rows and body means are arranged transversely to the air stream.

27. A heat-exchanger according to claim 1, characterized in that the pipe means of a row are also constructed in the form of expanded partial composite laminated body means which together with the partial composite laminated body means of the heat-exchanger head means belonging to the same row are integrated into a one-piece structural unit of a heat-exchanger plate means.

28. A heat-exchanger according to claim 27, characterized in that the heat-exchanger plate means are provided with longitudinal slots extending between the pipe means substantially parallelly thereto for an air passage directed transversely to the heat-exchanger plate means.

29. A heat-exchanger according to claim 28, characterized in that the longitudinal slots are subdivided into several shorter apertures arranged one behind the other by stabilizing web means.

30. A heat-exchanger according to claim 27, characterized in that the heat-exchanger plate means include within the area of the individual pipe means several tongue portions projecting out of the plane of the plate means and punched out of the plate material in the manner of heat-transfer ribs.

31. A heat-exchanger according to claim 27, characterized in that the heat-exchanger plate means are aligned substantially parallel to the air stream.

32. A heat-exchanger according to claim 1, characterized in that the body means of at least one heat-exchanger and of the heat-exchanger head means are formed by correspondingly larger partial composite laminated body uniformly folded flat one over the other in zig-zag shape.

33. A heat-exchanger according to claim 1 or 32, characterized in that one heat-exchanger head means each is provided at the two ends of the pipe bundle, of which one is adapted to be acted upon by a heat-carrier medium warmer than the space temperature and the other with a heat-carrier medium colder than the dew point temperature of the acted-upon air, and in that the heat-carrier channel means of the body means are subdivided within the area of the two heat-exchanger head means into two independent sections disposed one behind the other in the air flow direction and each provided with separate inlet and outlet connections, in such a manner that only a part of the pipe rows of the pipe bundle is adapted to be acted upon by itself by one of the heat-exchanger head means and at the same time the other part of the pipe row is adapted to be acted upon by the other heat-exchanger head means.

* * * * *